US005960968A

United States Patent [19]

Wang

[11] Patent Number: 5,960,968

[45] Date of Patent: Oct. 5, 1999

[54] TABLE WITH ADJUSTABLE SHELVES

[75] Inventor: Ken Wang, Chang Hua, Taiwan

[73] Assignee: Alltrend Co., Ltd., Chang Hua, Taiwan

[21] Appl. No.: 09/102,645

[22] Filed: Jun. 23, 1998

[51] Int. Cl.[6] ..... A47F 5/00

[52] U.S. Cl. ..... 211/187; 108/147.13

[58] Field of Search ..... 211/187, 181.1, 211/186, 133.1; 108/147.11, 147.12, 147.13, 147.14

[56] References Cited

U.S. PATENT DOCUMENTS

| | | | |
|---|---|---|---|
| 4,079,678 | 3/1978 | Champagne | 211/187 X |
| 4,595,107 | 6/1986 | Welsch | 211/187 |
| 4,629,077 | 12/1986 | Niblock | 211/187 |
| 4,750,626 | 6/1988 | Nicely | 211/187 |
| 5,127,342 | 7/1992 | Taylor | 211/187 X |
| 5,409,122 | 4/1995 | Lazarus | 211/186 |
| 5,683,004 | 11/1997 | Aho | 211/133.1 X |
| 5,779,070 | 7/1998 | Dickinson et al. | 211/187 |
| 5,797,503 | 8/1998 | Stevens et al. | 211/187 |

*Primary Examiner*—Robert W. Gibson, Jr.
*Attorney, Agent, or Firm*—Browdy and Neimark

[57] ABSTRACT

A table with adjustable shelves including four supporting rods, several collars, several retaining boards, a cover board, several supporting beams and several bridge beams. Each corner of the retaining board is formed with an arch recess. The supporting beam includes a linkage each end of which is connected with a C-shaped conic fixing sleeve. Two sides of top edge of the linkage are respectively formed with two dented section. When assembled, from lateral upper sides of the collars, the C-shaped conic fixing sleeves of the supporting beams are downward fitted onto the supporting rods and engaged with the collars fitted around the supporting rods. The bridge beams are bridged between the linkages of the supporting beams with the ends of the bridge beams inserted in the dented sections thereof. The retaining board is positioned between the supporting rods and rested on the supporting beams and the bridge beams. The supporting beams, bridge beams and the retaining board 40 can be easily and quickly adjustably assembled and disassembled.

1 Claim, 4 Drawing Sheets

TABLE WITH ADJUSTABLE SHELVES

BACKGROUND OF THE INVENTION

The present invention relates to a table, which has adjustable shelves and can be easily assembled and disassembled.

FIG. 1 shows a conventional fixed table which is composed of several supporting rods 1 and several partitioning boards or shelves 2 fixedly assembled with the supporting rods 1. The partitioning boards 2 of the table are unadjustable limiting the table usefulness. Moreover, when not used, such fixed table cannot be disassembled. Accordingly, the table will occupy more room and is difficult to store.

FIG. 2 shows another conventional table which can be adjusted and disassembled. Such table is composed of four supporting rods 10, several collars 20, several supporting frames 30, several retaining boards 40 and a cover board 50. Each supporting rod 10 is formed with multiple annular locating grooves 11 at equal intervals. A soft pad member 12 is fitted with lower end of the supporting rod 10. The collar 20 is composed of two conic semicircular plates 21 tapered from lower side the to upper side. One side of the conic semicircular plate 21 is formed with a notch 211, while the other side thereof is formed with a corresponding projection 212. The inner face of the conic semicircular plate 21 is formed with an annular rib 213. The supporting frame 30 is composed of four conic fixing sleeves 31 and four linking beams 32. Each corner of the retaining board 40 is formed with an arch recess 41. The bottom face of each corner of the cover board 50 is formed with a socket 51.

When assembled, as shown in FIG. 3, the conic semicircular plates 21 of the collars 20 are attached to the supporting rods 10 and the projections 212 are snugly fitted into the notches 211 to mate the conic semicircular plates 21 with each other. In addition, the annular ribs 213 of the collars 20 are fitted into the locating grooves 11 of the supporting rods 10 to locate the collars 20. Then the fixing sleeves 31 of the supporting frame 30 are fitted around the supporting rods 10 and engaged with the collars 20. Then the retaining board 40 is positioned between the supporting rods 10. The recessed arc 41 permit the retaining board 40 to avoid the supporting rods 10 and the fixing sleeves 31 of the supporting frame 30 and rest on the linking beams 32 of the supporting frame 30. According to such procedure, additional supporting frames 30 and retaining boards 40 can be further assembled with the supporting rods 10 and then the cover board 50 is laid on the supporting rods 10 with the top ends thereof inserted into the sockets 51 of the cover board 50.

When it is desired to adjust the positions of the supporting frame 30 and the retaining board 40, first the supporting frame 30 and the retaining board 40 are moved upward to disengage the fixing sleeves 31 from the collars 20 of the supporting rods 10. Then the collars 20 are moved to the desired positions and re-located. Then the fixing sleeves 31 of the supporting frame 30 are again fitted on and engaged with the collars 20. Then the retaining board 40 can be placed on the linking beams 32 of the supporting frame 30.

According to such arrangement, the positions of the supporting frame 30 and the retaining board 40 can be adjusted and the article rest can be disassembled to facilitate storage. However, the fixing sleeves 31 are often too tightly fitted with the collars 20 so that it is quite difficult to loosen and disengage the fixing sleeves 31 from the collars 20.

SUMMARY OF THE INVENTION

It is therefore a primary object of the present invention to provide a table including several supporting beams and cooperative bridge beams for supporting a retaining board. The supporting beam includes a linkage each end of which is connected with a C-shaped conic fixing sleeve. When assembled, from lateral upper sides of the collars, the C-shaped conic fixing sleeves of the supporting beams are downward fitted onto the supporting rods and engaged with the collars fitted around the supporting rods. The supporting beams, bridge beams and the retaining board 40 can be easily and quickly adjusted assembled or disassembled so that the table can be flexibly and conveniently used.

It is a further object of the present invention to provide the above table in which the supporting beams can be fitted alone with the collars between the supporting beams for hanging article thereon.

The present invention can be best understood through the following description and accompanying drawings, wherein:

DETAILED DESCRIPTION OF THE PREFERRED EMBODIMENTS

Figure 3:
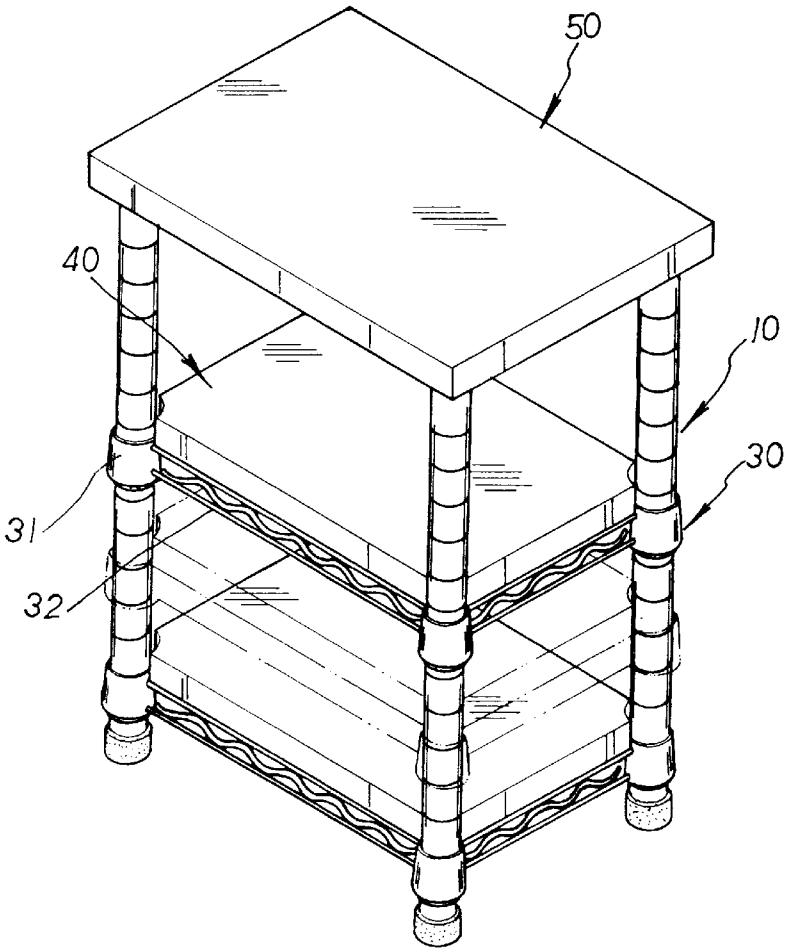
FIG. 3 PRIOR ART
FIG. 3 is a perspective assembled view according to FIG. 2, showing the adjustment thereof.
Figure 1:
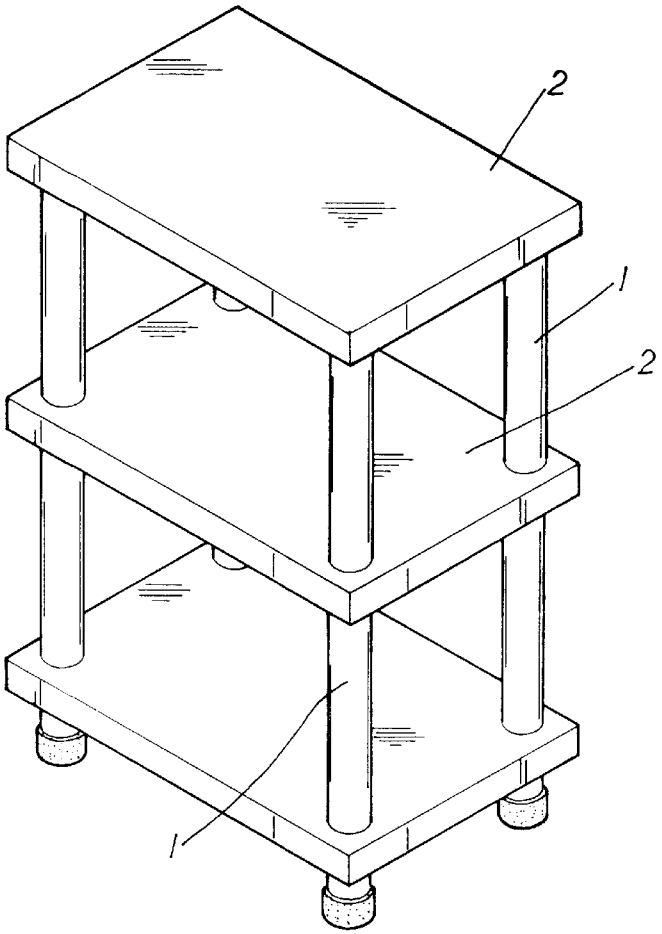
FIG. 1 PRIOR ART
FIG. 1 is a perspective assembled view of a conventional table.
Figure 2:
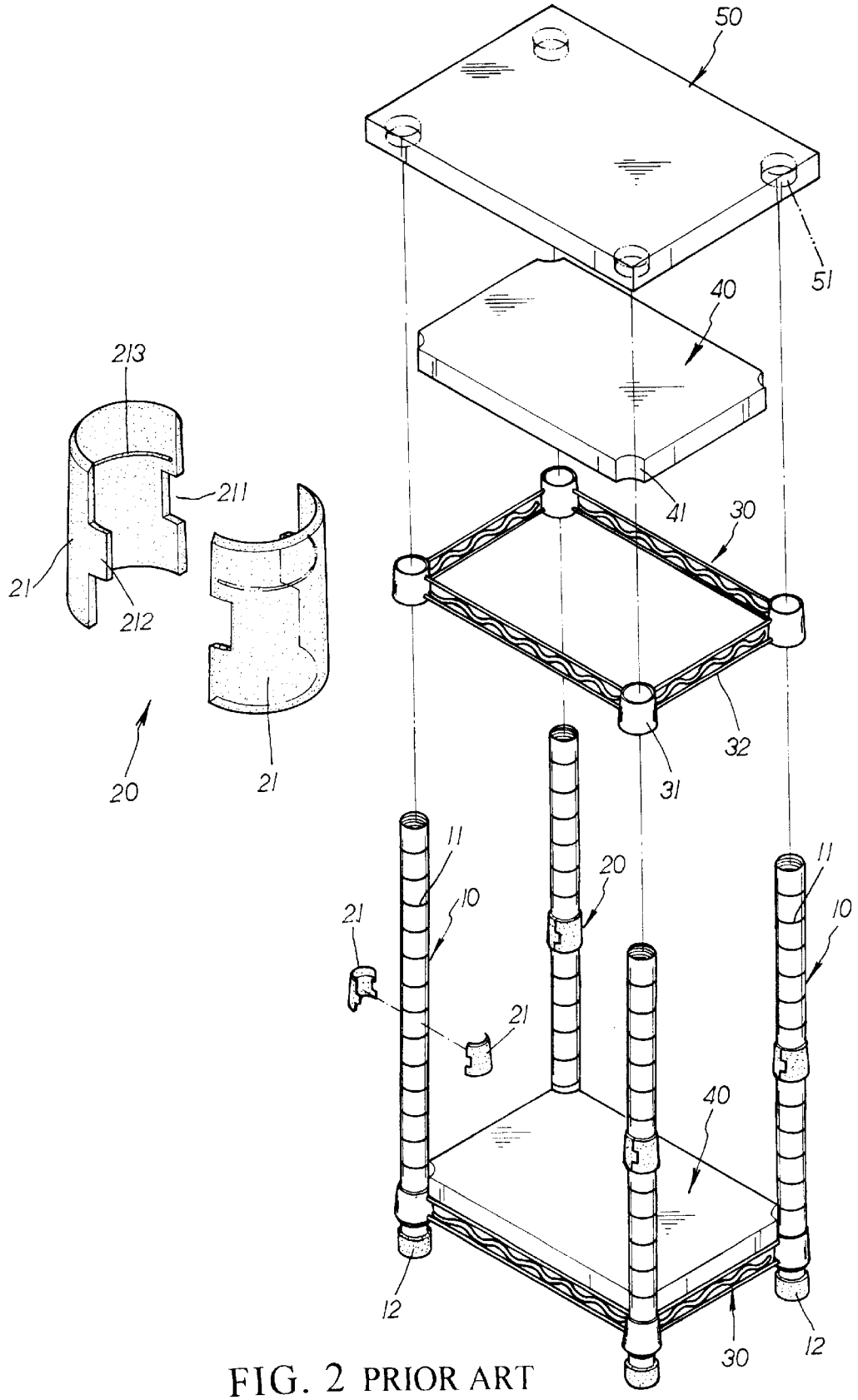
FIG. 2 PRIOR ART
FIG. 2 is a perspective exploded view of another conventional table which can be adjusted and disassembled.
Figure 4:
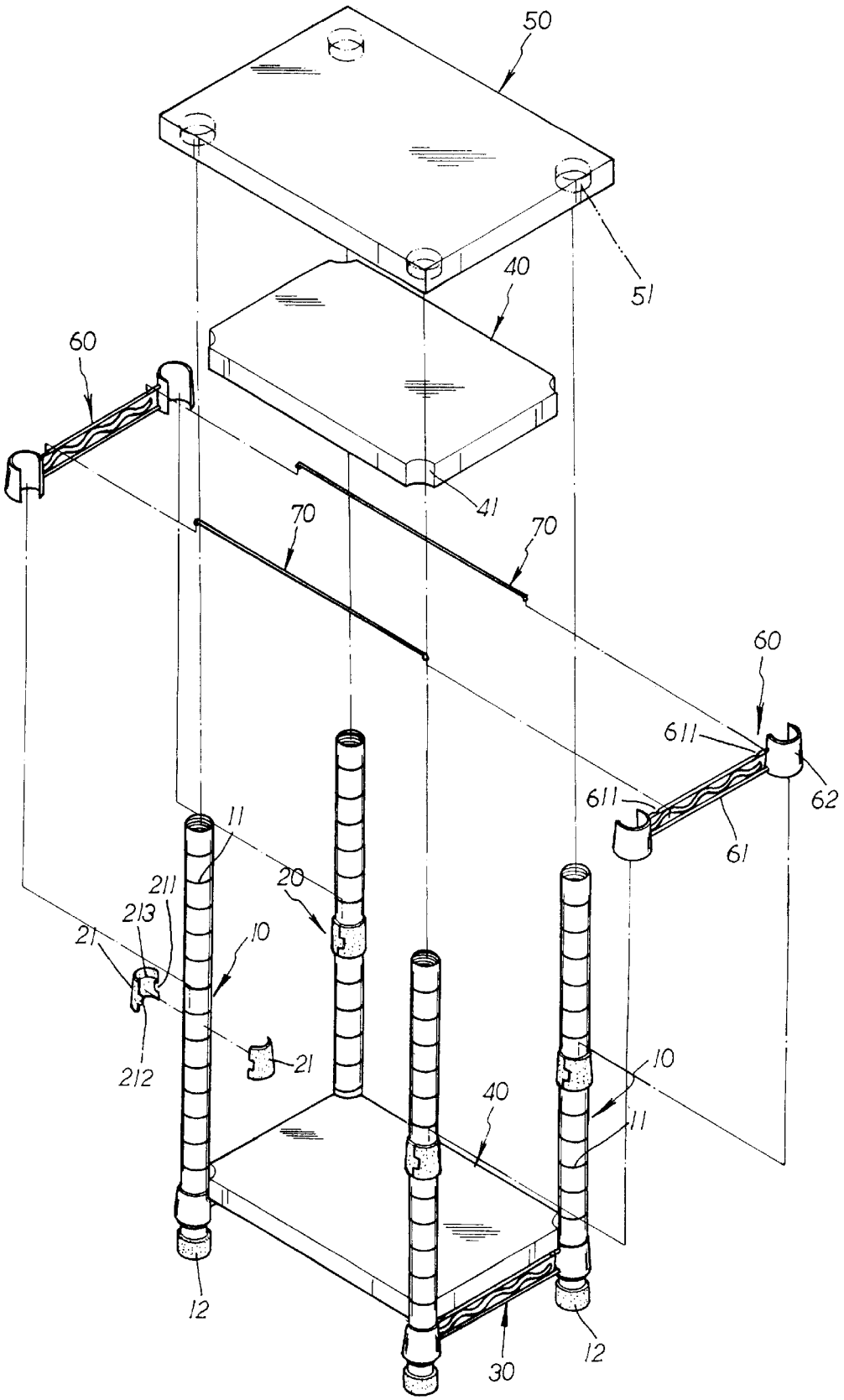
FIG. 4 is a perspective exploded view of the table of the present invention.

Please refer to FIG. 4. The table of the present invention includes four supporting rods 10, several collars 20, several retaining boards 40, a cover board 50, several supporting beams 60 and several bridge beams 70. Each supporting rod 10 is formed with multiple annular locating grooves 11 at equal intervals. A soft pad body 12 is fitted with the lower end of the supporting rod 10. The collar 20 is composed of two conic semicircular plates 21 tapered from lower side to upper side. One side of the conic semicircular plate 21 is formed with a notch 211, while the other side thereof is formed with a corresponding projection 212. The inner face of the conic semicircular plate 21 is formed with an annular rib 213. Each corner of the retaining board 40 is formed with an recessed arc 41. The bottom face of each corner of the cover board 50 is formed with a socket 51. The supporting beam 60 includes a linkage 61 each end of which is connected with a C-shaped conic fixing sleeve 62. Two sides of top edge of the linkage 61 are respectively formed with a dented or recessed section 611.

Figure 5:
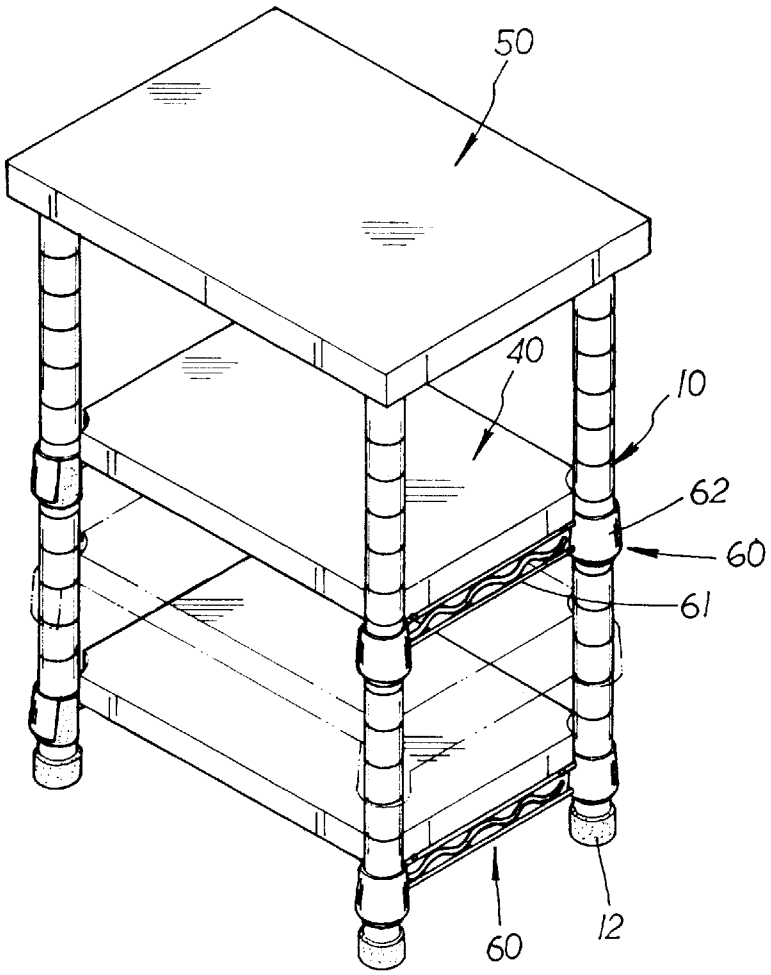
FIG. 5 is a perspective assembled view of the table of the present invention, showing the adjustment thereof.
Figure 6:
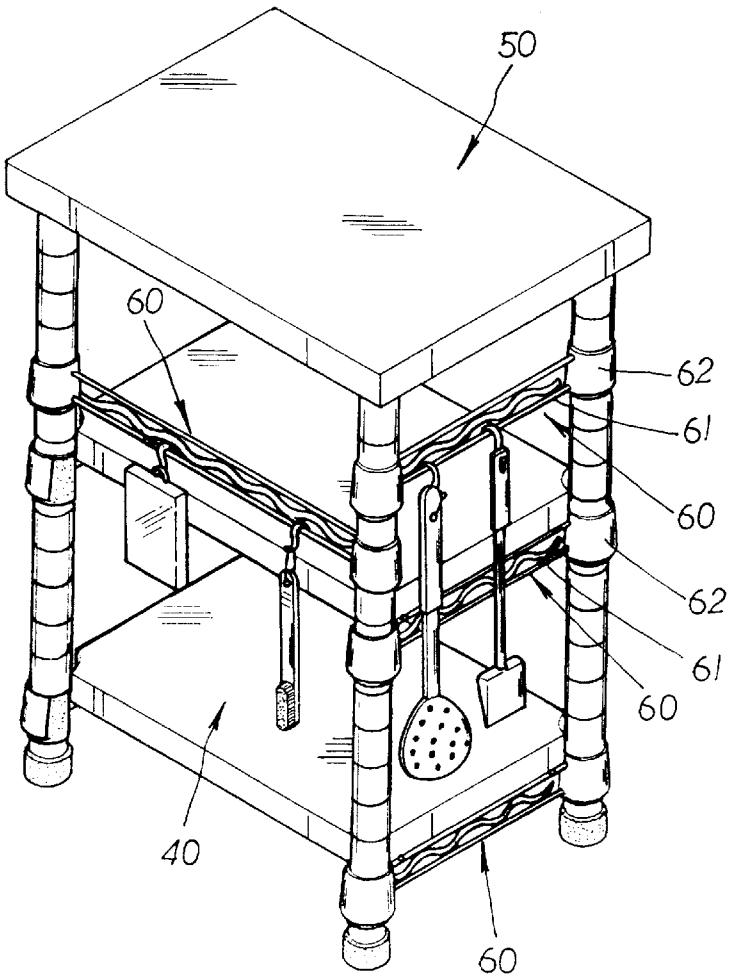
FIG. 6 is a perspective assembled view of the table of the present invention in another aspect for hanging an article thereon.

Please refer to FIG. 5. When assembled, the conic semicircular plates 21 of the collars 20 are attached to the supporting rods 10 and the projections 212 are snugly fitted into the notches 211 to mate the conic semicircular plates 21 with each other. In addition, the annular ribs 213 of the collars 20 are fitted into the locating grooves 11 of the supporting rods 10 to locate the collars 20. Then, from lateral upper sides of the collars 20, the C-shaped conic fixing sleeves 62 of the supporting beams 60 are downward fitted onto the supporting rods 10 and engaged with the collars 20. Then the bridge beams 70 are bridged between the linkages 61 of the supporting beams 60 with the ends of the bridge beams 70 inserted in the dented or recessed sections 611 thereof. Then the retaining board 40 is positioned between the supporting rods 10. The recessed arc 41 permit the retaining board 40 to avoid the supporting rods 10 and the fixing sleeves 62 of the supporting beams 60 and rest on the linkages 61 of the supporting beams 60 and the bridge beams 70. According to such procedure, additional supporting beams 60, bridge beams 70 and retaining boards 40 can be further assembled with the supporting rods 10 and then the cover board 50 is laid on the supporting rods 10 with the top ends thereof inserted into the sockets 51 of the cover board 50.

When it is desired to adjust the positions of the supporting beams 60, bridge beams 70 and the retaining board 40, first the supporting frame 60, bridge beams 70 and the retaining board 40 are moved upward to disengage the C-shaped conic fixing sleeves 62 from the collars 20 of the supporting rods 10. Then the collars 20 are moved to the desired positions and re-located. Then the C-shaped conic fixing sleeves 62 of the supporting beams 60 are again downward fitted onto and engaged with the collars 20. Then the bridge beams 70 are again bridged between the linkages 61 with the ends inserted in the dented or recessed sections 611. Then the retaining boards 40 are again placed on the linkages 61 and the bridge beams 70 to complete the assembly.

According to such arrangement, the present invention has the following advantages:

1. The supporting beams 60, bridge beams 70 and the retaining board 40 can be easily and quickly adjustably assembled and disassembled so that the table can be conveniently used.

The above description and accompanying drawings are only used to illustrate some embodiments of the present invention. Any modification or variation derived from the embodiments should fall within the scope of the present invention.

What is claimed is:

1. A table comprising:

a plurality of supporting rods, collars, retaining boards, supporting beams and bridge beams; and a cover board each of said supporting rods being formed with multiple annular locating grooves spaced apart at equal intervals and having a soft pad on a lower end of the supporting rods;

each of said collars being composed of two conic semicircular plates tapered from a lower side to an upper side;

a first side of each of the two conic semicircular plates being formed with a notch and a second side with a projection;

an inner face of each of the two conic semicircular plates being formed with an annular rib;

corners of each of the retaining boards being formed with a recessed arc;

a bottom face of the cover board having a socket at each corner of the cover board;

the collars being attached to the supporting rods by engaging the projection in the notch of each of the two conic semicircular plates with the annular rib of each of the two conic semicircular plates engaged in an annular locating groove of said locating grooves;

the supporting beam having a linkage whose ends are each connected to a C-shaped conic fixing sleeve; a top edge of the linkage having two spaced apart recessed sections;

wherein when assembled, the C-shaped conic fixing sleeves of the supporting beams are fitted over the supporting rods when engaged to the collars, the bridge beams are engaged to the linkages of the supporting beams when each end of the bridge beams are inserted into the two recessed sections, the retaining boards being positioned between the supporting rods with each recessed arc permitting the retaining boards to fit around the supporting rods and the C-shaped conic fixing sleeves of the supporting beams and rest on the linkages of the supporting beams and the bridge beams, and the top end of each of the supporting rods engaged in the socket of said cover board.

* * * * *